United States Patent [19]

Pettit

[11] Patent Number: 4,722,514

[45] Date of Patent: Feb. 2, 1988

[54] PLASTIC FENCE CONSTRUCTION

[76] Inventor: Frederick M. Pettit, 1411 Point Abino Rd. S., Ridgeway, Ontario L0S 1N0, Canada

[21] Appl. No.: 669,468

[22] Filed: Nov. 8, 1984

[51] Int. Cl.[4] ..... E04H 17/16

[52] U.S. Cl. ..... 256/50; 256/66; 256/19

[58] Field of Search ..... 256/50, 65, 66, 19, 256/72, 59

[56] References Cited

U.S. PATENT DOCUMENTS

| | | | |
|---|---|---|---|
| 3,304,683 | 2/1967 | Ferreira | 256/65 X |
| 3,370,836 | 2/1968 | Ashworth et al. | 256/47 |
| 3,700,213 | 10/1972 | Blease | 256/59 X |
| 3,776,523 | 12/1973 | Weiland | 256/59 |
| 4,007,919 | 2/1977 | Totten | 256/59 |
| 4,027,855 | 6/1977 | Lauzier | 256/59 X |
| 4,140,298 | 2/1979 | Coleman, Jr. | 256/65 |
| 4,334,671 | 6/1982 | De Guise | 256/65 |
| 4,540,160 | 9/1985 | Zanavich et al. | 256/19 |
| 4,553,741 | 11/1985 | Creasy et al. | 256/66 |
| 4,609,185 | 9/1986 | Prater et al. | 256/65 |

FOREIGN PATENT DOCUMENTS

| | | | |
|---|---|---|---|
| 13659 | of 1908 | United Kingdom | 256/65 |

*Primary Examiner*—Richard J. Scanlan, Jr.
*Assistant Examiner*—Joseph A. Fischetti
*Attorney, Agent, or Firm*—Joseph P. Gastel

[57] ABSTRACT

A plastic fence having spaced hollow plastic posts with vertically spaced holes in the posts for receiving rails with a friction fit with the rails having vertical rungs, slats, or both which are received between the rails with a friction fit. A plastic gate construction including a frame fabricated from plastic frame sections connected by elbows, vertical rung and slat members extending vertically in the frame, and plastic hinge members formed integrally with the elbows for mating with co-operating hinge elements mounted on sleeves which are secured to a post of a fence.

20 Claims, 37 Drawing Figures

Fig. 1.
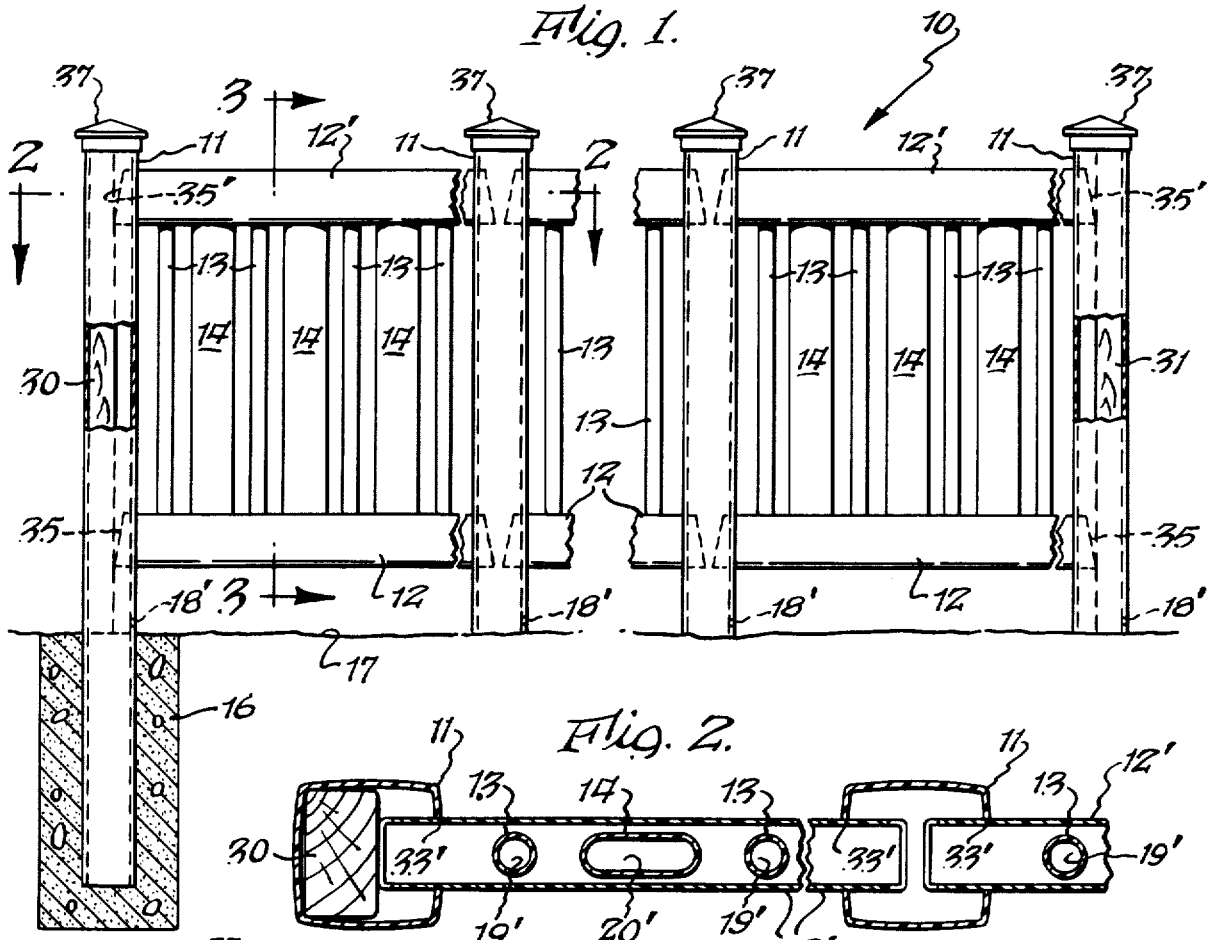
Fig. 2.
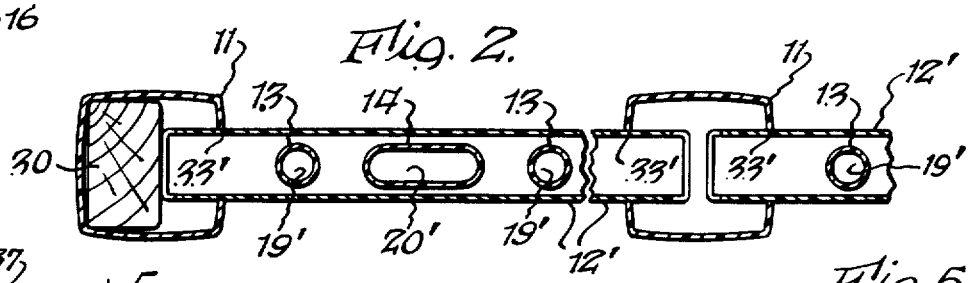
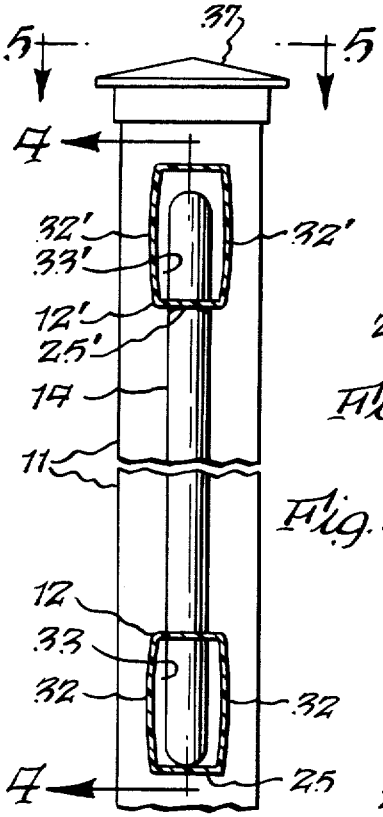
Fig. 3.
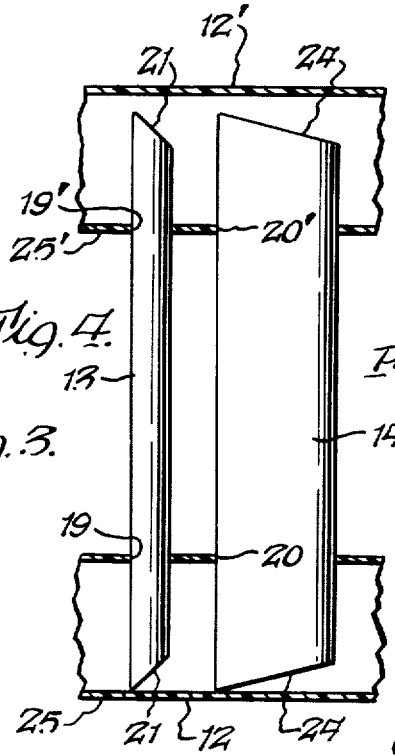
Fig. 4.
Fig. 5.
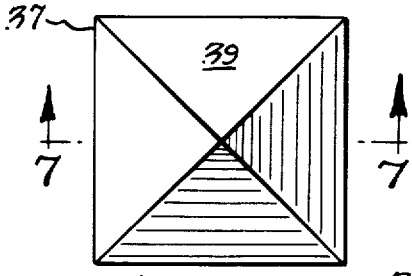
Fig. 6.
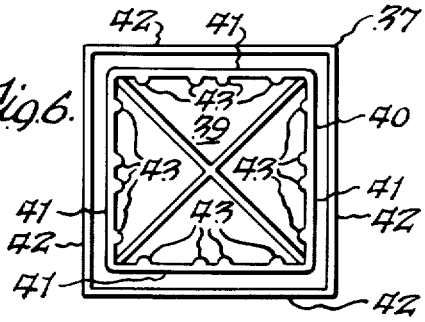
Fig. 7.
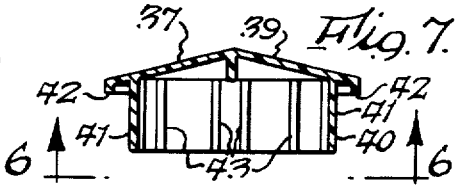

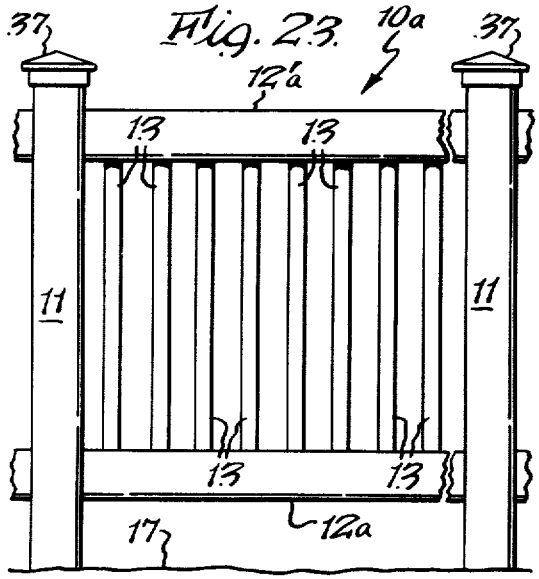
Fig. 23.
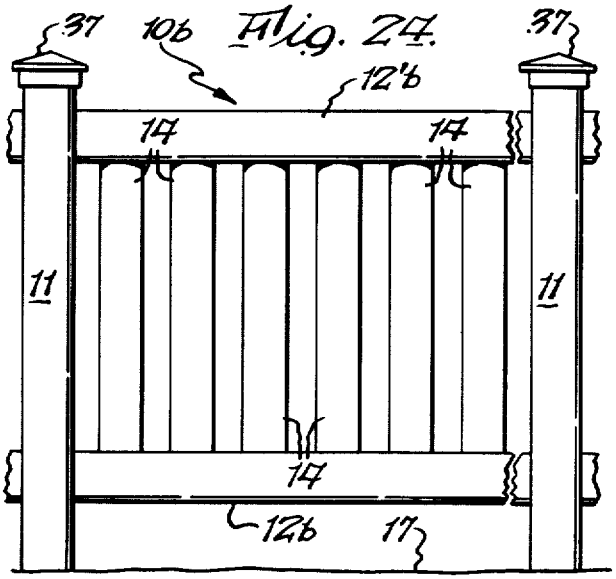
Fig. 24.
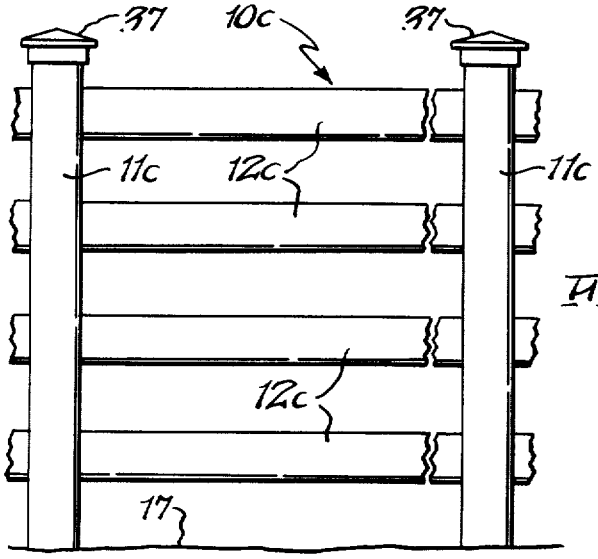
Fig. 25.
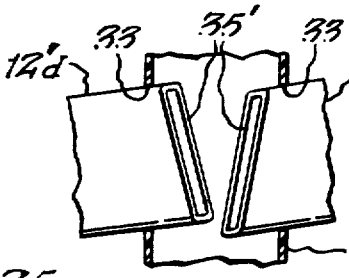
Fig. 27.
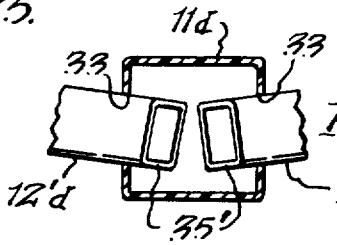
Fig. 29.
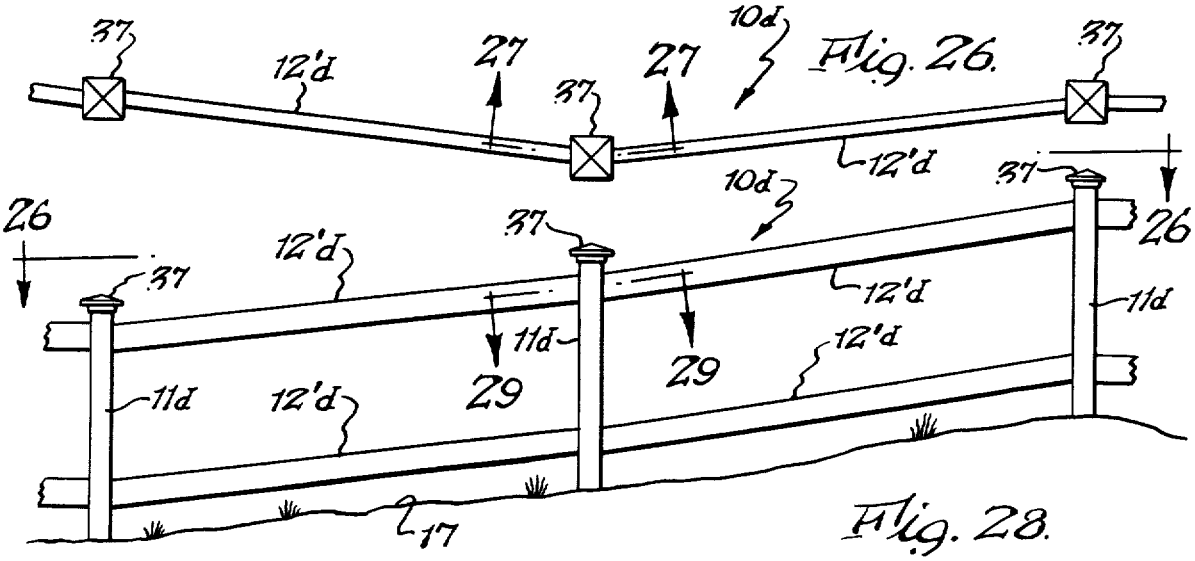
Fig. 26.
Fig. 28.

PLASTIC FENCE CONSTRUCTION

BACKGROUND OF THE INVENTION

The present invention relates to a plastic fence construction.

While plastic fence constructions are known for the purpose of overcoming the deficiencies of wooden and metal fences, namely, rotting, cracking, warping, decay, rusting and the need for painting, it is not known by the inventor that the prior art plastic fences could be assembled without the use of tools to provide a good solid fence construction which could also be disassembled without the use of tools.

SUMMARY OF THE INVENTION

It is one important object of the present invention to provide an improved plastic fence construction which can be assembled without the use of tools and which, once assembled, will be extremely sturdy so that the parts will not rattle when subjected to wind forces, but will be able to move relative to each other to allow for expansion and contraction.

Another object of the present invention is to provide an improved plastic fence construction wherein the parts have beveled end portions which permit them to be inserted into holes in other portions in an extremely simple manner, notwithstanding that the parts thereafter have a friction-fit relationship with each other.

A further object of the present invention is to provide an improved plastic fence construction wherein there is a saving of material because of the fact that certain of the parts have beveled ends.

Yet another object of the present invention is to provide improved plastic fence constructions having certain standard parts which can be used to provide different styles of fences.

A still further object of the present invention is to provide an improved plastic fence construction in which the parts are flexible and resilient so that the fence can be fabricated with sections which are not in alignment with each other either vertically or horizontally.

Still another object of the present invention is to provide an improved plastic gate structure which can be used in conjunction with the improved plastic fence. Other objects and attendant advantages of the present invention will readily be perceived hereafter.

The present invention relates to a plastic fence comprising a plurality of spaced hollow plastic posts, vertically spaced holes in said posts, said holes having substantially parallel sides which are spaced apart a first distance, vertically spaced hollow horizontal plastic rails having outwardly bowed side walls which have portions which are spaced apart a second distance which is greater than said first distance, said side walls being resilient and flexible to permit them to be squeezed together to fit into said holes with a friction fit.

The present invention also relates to a plastic gate for a fence comprising tubular hollow plastic members, plastic elbows joining said tubular hollow plastic members into a quadrangular configuration, plastic sleeves for mounting in spaced relationship on a post, and hinge connections between said gate and said plastic sleeves.

The various aspects of the present invention will be more fully understood when the following portions of the specification are read in conjunction with the accompanying drawings wherein:

BRIEF DESCRIPTION OF THE DRAWINGS

FIG. 1 is a fragmentary side elevational view of one embodiment of a plastic fence of the present invention;

FIG. 2 is an enlarged fragmentary cross sectional view taken substantially along line 2—2 of FIG. 1;

FIG. 3 is an enlarged fragmentary cross sectional view taken substantially along line 3—3 of FIG. 1;

FIG 4 is a fragmentary cross sectional view taken substantially along line 4—4 of FIG. 3;

FIG. 5 is a plan view of a post cap taken substantially in the direction of arrows 5—5 of FIG. 3;

FIG. 6 is a bottom plan view of the post cap taken substantially in the direction of arrows 6—6 of FIG. 7;

FIG. 7 is a cross sectional view taken substantially along line 7—7 of FIG. 5;

FIG. 23 is a fragmentary side elevational view showing another embodiment of the present invention utilizing only rungs mounted between the rails;

FIG. 24 is a fragmentary side elevational view of another embodiment of the present invention showing only slats mounted between the rails;

FIG. 25 is a fragmentary side elevational view of still another embodiment of the present invention showing only rails mounted between adjacent posts;

FIG. 26 is a fragmentary plan view taken substantially in the direction of arrows 26—26 of FIG. 28 and showing a plurality of non-aligned posts and showing the manner in which the rails are oriented relative thereto;

FIG. 27 is a fragmentary cross sectional view taken substantially along line 27—27 of FIG. 26 and showing the orientation between the ends of the rails within a post;

FIG. 28 is a fragmentary side elevational view of a fence wherein the posts are at different elevations on a slope;

FIG. 29 is a fragmentary cross sectional view taken substantially along line 29—29 of FIG. 28 and showing the orientation between adjacent rails within the posts;

DESCRIPTION OF THE PREFERRED EMBODIMENTS

Figures 8, 9, 10, 11, 12, 13, 14, 15, 16, 17, 18, 19, 20, 21, 22:
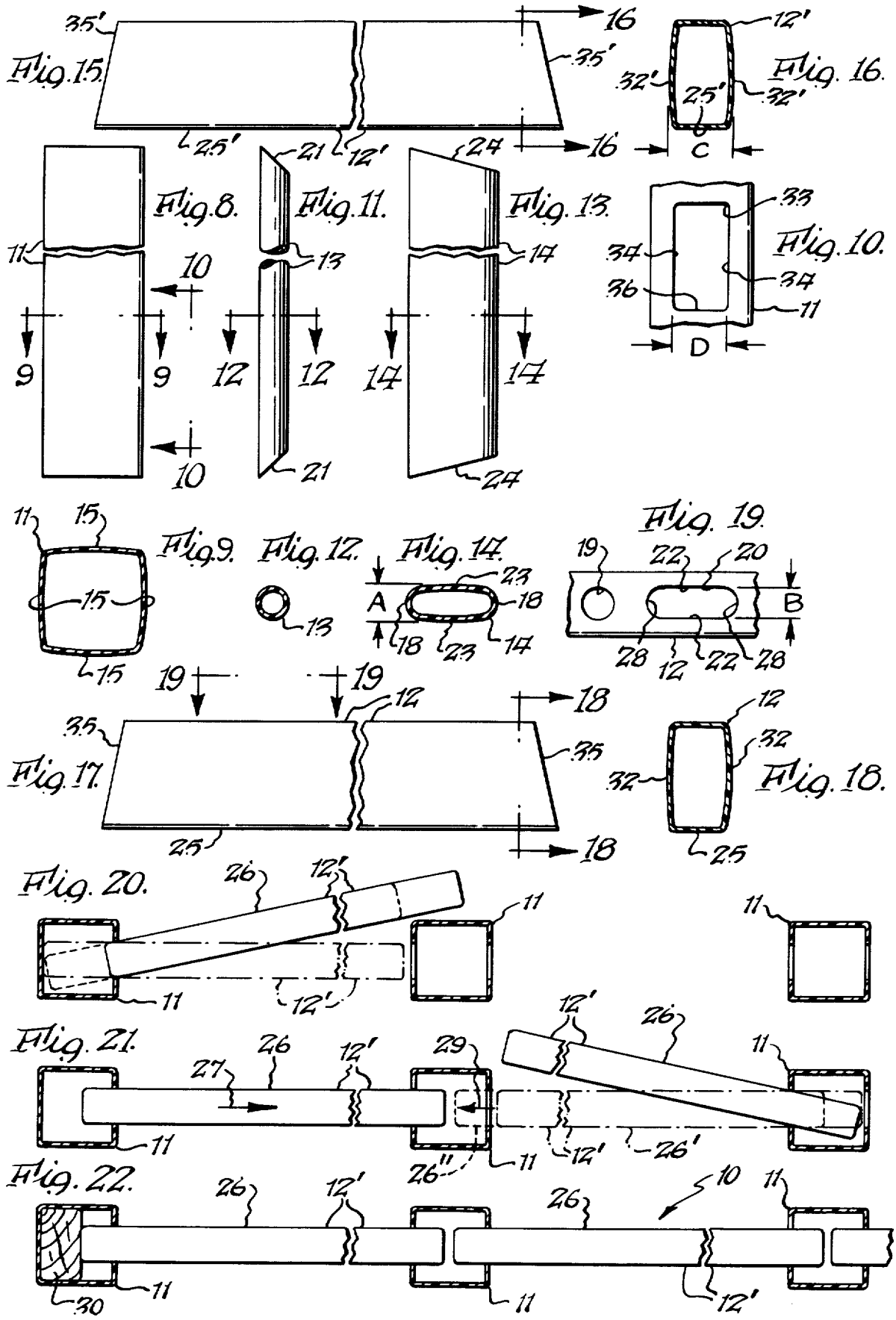
FIG. 8 is a fragmentary side elevational view of a post.
FIG. 9 is a cross sectional view taken substantially along line 9—9 of FIG. 8.
FIG. 10 is a view taken substantially in the direction of arrows 10—10 of FIG. 8 and showing a rail receiving opening in the post.
FIG. 11 is a fragmentary side elevational view of a rung of the fence.
FIG. 12 is a cross sectional view taken substantially along line 12—12 of FIG. 11.
FIG. 13 is a fragmentary side elevational view of a slat of the fence.
FIG. 14 is a cross-sectional view taken substantially along line 14—14 of FIG. 13.
FIG. 15 is a fragmentary side elevational view of a top rail of the fence.
FIG. 16 is a cross sectional view taken substantially along line 16—16 of FIG. 15.
FIG. 17 is a fragmentary side elevational view of the bottom rail of the fence.
FIG. 18 is a cross sectional view taken substantially along line 18—18 of FIG. 17.
FIG. 19 is a view of the slat and rung-receiving openings in the bottom rail taken substantially in the direction of line 19—19 of FIG. 17.
FIG. 20 is a schematic view showing the first step in installing a subcombination of two rails, slats and rungs between adjacent posts which have been set into the ground.
FIG. 21 is a view similar to FIG. 20 but showing the second step of mounting the subcombination into the next adjacent post and also showing the steps in mounting a second subcombination relative to the second post and a third post adjacent thereto.
FIG. 22 is a view similar to FIG. 21 but showing a plurality of subcombinations in assembled relationship with adjacent posts.

One embodiment 10 of the improved plastic fence is disclosed in FIGS. 1–22. All parts of the fence 10 are made of polyvinyl chloride (PVC) plastic except as specifically indicated. The thickness of the plastic is preferably between about ⅛ inch and 3/16 inches, but it can be of any desired thickness. The fence includes a plurality of posts 11 into which rails 12 and 12′ are inserted. Rungs 13 and slats 14 are carried by rails 12 and 12′. Posts 11 are hollow and are substantially square in cross section except that the sides 15 (FIGS. 2 and 9) of the posts are slightly bowed outwardly. The posts 11 are preferably set in concrete 16 in holes made in ground 17. The centerlines of post 11 are spaced apart a distance which is approximately ½ inch longer than the length of rails 12 and 12′, to thereby provide clearances for expansion of the rails 12 and 12′.

After the posts 11 have been installed in the ground, a subassembly is made up of upper rail 12′, lower rail 12, rungs 13, and slats 14. In order to receive rungs 13 and slats 14, bottom rail 12 has round holes 19 and elongated holes 20 (FIG. 19), respectively. Round holes 19 receive cylindrical rungs 13 with an interference fit so that the rungs do not rattle in rail 12. To facilitate the installation of rungs 13 into holes 19, the ends 21 of rungs 13 are beveled at 21 (FIG. 12) which provide lead-in portions so that the end 21 of each rung 13 can be forced into hole 19. The holes 20 in bottom rail 12 have parallel sides 22 and rounded ends 28 (FIG. 19). The sides 23 (FIG. 14) of slats 14 are bowed outwardly so that the distance A (FIG. 14) is greater than the spacing B (FIG. 19) of sides 22. The end portions 18 (FIG. 14) of slats 14 are rounded for complementary mating engagement with rounded ends 28 of holes 20. The ends 24 of slats 14 are beveled to facilitate insertion of the end 24 of each slat 14 into hole 20. The sides 23 of each plastic slat 14 are resilient and flexible. This permits the sides 23 to be squeezed toward each other during installation into hole 20, and after such installation, they will tend to return to their original bowed condition to provide a good tight friction fit against the sides 22 and within holes 20 to prevent rattling and also minimize leakage of water into rail 12.

The upper rail 12′ is of the same length and shape as lower rail 12. However, upper rail 12′ has the holes exactly like holes 19 and 20 in its lower surface 25 rather than in its upper surface, as does lower rail 12. More specifically, upper rail 12′ has holes 19′ and 20′ (FIG. 2) which are identical to holes 19 and 20 of lower rail 12 except that they are in lower side 25′. Holes 19′ and 20′ receive the ends of rungs 13 and slats 14 in the same manner as they are received in holes 19 and 20. The beveled ends 21 and 24 of rungs 13 and slats 14 not only facilitate assembly but also save material.

After a subassembly of rails 12 and 12′, rungs 13 and slats 14 has been made, this subassembly 26 is installed between a pair of adjacent posts 11. In this respect, as can be seen from FIG. 20, the left end of the subassembly 26 is inserted into the left post 11 by moving it from its solid line position to its dotted line position and then pivoted clockwise to its dash-dot line position. Thereafter, the subassembly 26 is moved to the right in the direction of arrow 27 until it occupies the solid line position of FIG. 21. Thereafter, another subassembly 26 is inserted into the post 11 at the extreme right of FIG. 21, as shown in solid lines, and thereafter is swung around to the dash-dot line position 26′ and thereafter moved in the direction of arrow 29 to the dotted line position 26″. This process is continued. After the foregoing installations have been made, a wooden bar 30 (FIGS. 1 and 22) is inserted in the post 11 at the extreme left and another wooden bar 31 (FIG. 1) is inserted in the post 11 at the end of a length of fence 10. The bars 30 and 31 prevent removal of subassemblies 26 from the posts. However, if for any reason it should be desired to disassemble the fence 10, it is merely required that either bar 30 or 31 be removed from post 11, and that the subassembly 26 be manipulated by a series of movements which are opposite to that described relative to FIGS. 20–22 to thereby remove the subassembly 26. In other words, if the left subassembly 26 in FIG. 22 is to be removed, bar 30 is removed from post 11, then the subassembly is moved to the left in a direction opposite to arrow 27, and it is thereafter pivoted from the dash-dot line position in FIG. 20 to the dotted line position and then moved to the solid line position, so that it can be removed from the post 11 at the left.

The sides 32 (FIG. 18) of rail 12 and the sides 32′ of rail 12′ (FIG. 16) are bowed outwardly, and they each have outermost portions spaced a distance C from each other. The vertically spaced holes 33 (FIG. 10) in posts 11 which receive rails 12 and 12′ have sides 34 (FIG. 10) which are spaced apart a distance D which is less than distance C. However, since sides 32 and 32′ of rails 12 and 12′, respectively, are resilient and flexible, they are squeezed together during insertion into holes 33, and they thereafter tend to return to their original shape to thereby provide a good tight friction fit with the posts. The ends 35 of each rail 12 and the ends 35′ of each rail 12′ are beveled (FIGS. 15 and 17) to both facilitate their insertion into holes 33 and also save material. It is to be especially noted that the longer lower bottom sides 25 and 25' of rails 12 and 12', respectively, rest on the bottom sides 36 of holes 33.

Caps 37 are installed on the tops of posts 11. Each cap 37 has an upper portion in the shape of a pyramid 39 having a square base which is molded integrally with a bottom section 40 having a square periphery consisting of sides 41. Also integrally molded with pyramid 39 is a rim 42. Ribs 43 are formed on the inside surfaces of sides 41. The inner edges of ribs 43 are spaced from diametrically opposite ribs 43 by an amount which is less than the maximum dimension of the outer surfaces of bowed sides 15 of posts 11. Since the sides 15 are resilient and flexible, they can be squeezed toward each other during mounting of caps 37 onto the ends of the posts and after the caps are fully mounted, the resiliency of sides 15 will cause them to bear against ribs 43, and thus caps 37 will be held in position with a good tight friction fit.

In FIG. 23 a modified embodiment **10*a* of the present invention is disclosed. In this embodiment posts 11 are identical to posts 11 of FIG. 1, as are caps 37. However, rails 12*a* and 12'*a* differ from rails 12 and 12', respectively, of FIG. 1 in that they have only round holes, such as 19 and 19', for receiving round rungs 13 which are identical to rungs 13 of FIG. 1**.

In FIG. 24 another embodiment **10*b* of the present invention is shown. In this embodiment posts 11 and caps 37 are identical to these elements shown in FIG. 1. However, rails 12*b* and 12'*b* differ from rails 12 and 12', respectively, of FIG. 1 in that they have only elongated openings, such as 20 (FIG. 19) and 20' (FIG. 2), respectively, for receiving slats 14 which are identical to slats 14 as shown in FIG. 1**.

In FIG. 25 still another embodiment **10*c* of the present invention is shown. In this embodiment posts 11*c* are identical to posts 11 of FIG. 1 except that they each have four vertically spaced openings 33 (FIG. 10) for receiving rails 12*c*, which are identical to rails 12 of FIG. 1 except that they have no openings, such as 19 and 20 (FIG. 19), because fence 10*c*** is strictly a rail type fence without rungs or slats.

In FIGS. 26–29 a rail fence construction **10*d* is shown wherein the posts 11*d* are both at different elevations and not in alignment with each other. The rails 12*d* and 12'*d* are identical to the rails 12 and 12' of FIG. 1 except that they do not have holes for receiving rungs and slats. The orientations of the rails relative to the posts in FIGS. 26 and 28 is possible because of the flexibility of the sides of the rails, as described above, and further because of the flexibility of the sides 15 of the posts. If desired, the holes 33 (FIG. 10) may be enlarged in the field to permit the rails 12*d* and 12'*d* to be oriented relative to the posts 11** as shown.

Figures 30, 31, 32, 33, 34, 35, 36, 37:
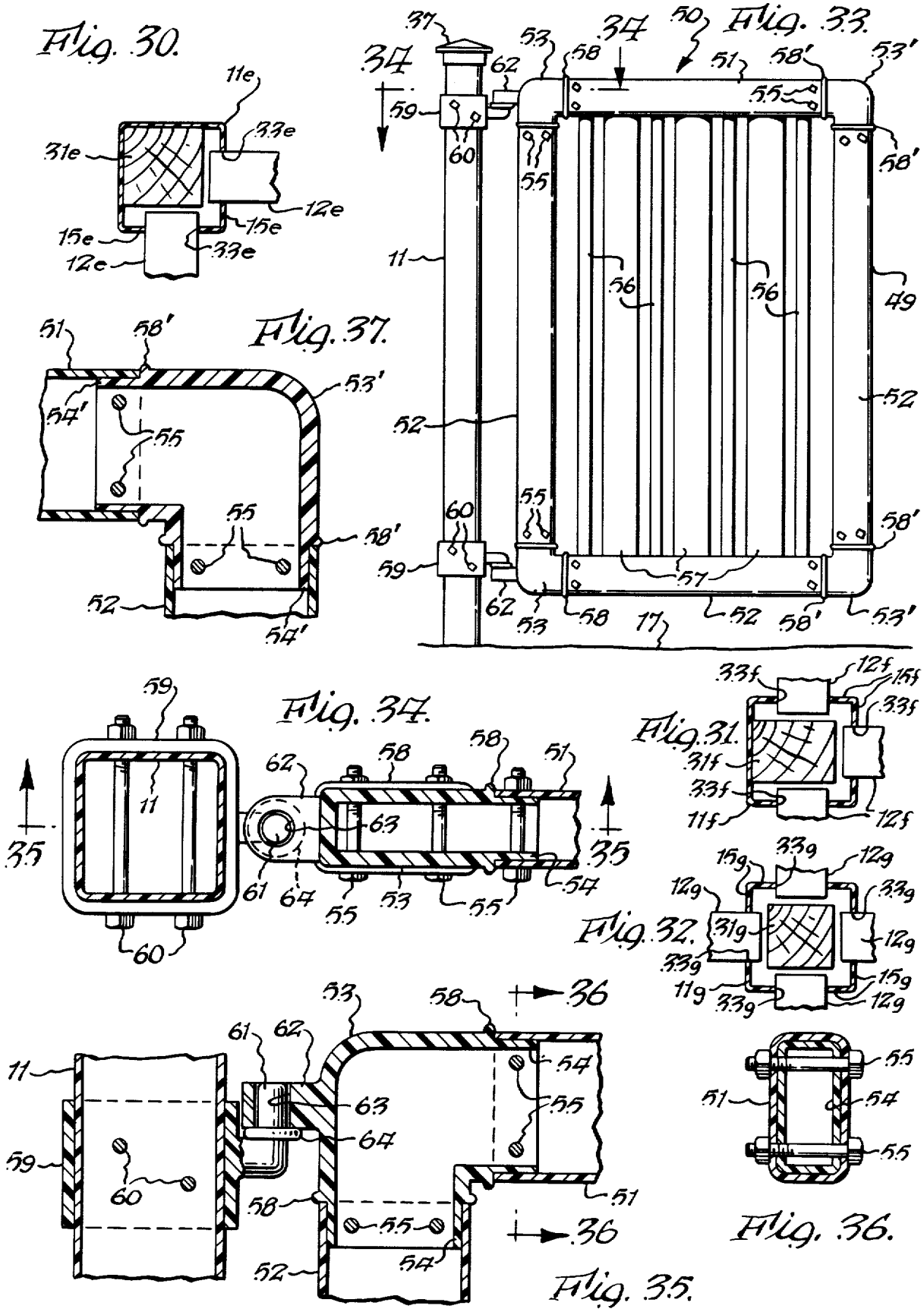
FIG. 30 is a fragmentary cross sectional view showing how two rails are received at right angles within a post which is located where two fence sections meet at right angles, such as at a corner of an enclosure.
FIG. 31 is a fragmentary cross sectional view showing how three rails are received within a post which is located where three fence sections meet.
FIG. 32 is a fragmentary cross sectional view showing how four rails are received in a post where four fence sections meet.
FIG. 33 is a side elevational view of a plastic gate construction for use with a fence of the present invention.
FIG. 34 is a fragmentary cross sectional view taken substantially along line 34—34 of FIG. 33 and showing the hinge construction between the gate and the post.
FIG. 35 is a fragmentary cross sectional view taken substantially along line 35—35 of FIG. 34.
FIG. 36 is a cross sectional view taken substantially along line 36—36 of FIG. 35.
FIG. 37 is a vertical cross section through the gate at the upper right end of FIG. 33.

In FIG. 30 a corner post **11*e* is shown which is identical in all respects to post 11 of FIG. 1 except that it has holes 33*e* in adjacent sides 15*e* or receiving rails 12*e*. The holes 33*e* and the rails 12*e* are analogous to rails 12 and holes 33, respectively, of FIGS. 1 and 10, respectively. A wooden bar 31*e*, which is analogous to board 31 of FIG. 1, but which is of a different shape, is inserted into post 11*e* to lock rails 12*e* in position. If there is an intereference between rails 12*e*, they can be cut shorter than shown in the embodiment of FIG. 1. Post 11*e*** is used where two fence sections meet.

In FIG. 31 a modified post **11*f* is shown which receives rails 12*f*, which are identical to rails 12, in three adjacent sides. Post 11 has holes 33*f* which are identical to holes 33 of FIG. 10. A bar 31*f* locks rails 12*f* in position. If the rails 12*f* interfere with each other, they can be cut shorter. Post 11*f*** is used where three fence sections meet.

In FIG. 32 a modified post **11*g* is shown which has holes 33*g* in all four sides 15*g* thereof for receiving rails 12*g*, which are identical to rails 12. A wooden bar 31*g* locks rails 12*g* in position. Rails 12*g* can be cut shorter if they interfere with each other. Post 11*g*** is used where four fence sections meet.

In FIGS. 33–36 an all-plastic gate 50 is shown which fits onto a post 11. Gate 50 is preferably fabricated from PVC. The frame 49 of gate 50 is fabricated from lower and upper horizontal plastic members 51 which are identical and side plastic members 52 which are also identical and which all have the substantially rectangular cross sectional configuration shown in FIG. 36. Plastic elbow members 53 and 53' connect the parts as shown in FIGS. 33–35. More specifically, elbows 53 and 53' include male outer end portions 54 and 54', respectively, which terminate at shoulders 58 and 58', respectively, which encircle the entire outer periphery. Frame members 51 and 52 slide onto end portions 54 and 54' and are secured thereto by bolts 55. Rungs 56 and slats 57 are received in holes, such as 19 and 20, respectively, (FIG. 19), in frame members 51. A weep hole (not shown) may be provided in the undersurface of lower frame member 51 for drainage. The gate 50 is assembled by first making a subassembly of parts 51, 56 and 57 and another subassembly of parts 52, 53 and 53' and thereafter combining the subassemblies.

A plastic hinge construction is provided for gate 50. In this respect sleeves 59 are mounted on posts 11 and secured thereto by bolts 60. Sleeves 59 have pins 61 (FIG. 35) formed integrally therewith. Elbows 53 have tabs 62 formed integrally therewith which have bores 63 therein for receiving pins 61. Washers 64 are positioned as shown.

Weep holes 18' are provided in posts 11 at about ground level to permit drainage of any rain water which enters posts 11 either directly or from rails 12. The joints between the various parts are sufficiently tight so that there is minimal likelihood of the fence being a haven for insects.

While the posts 11 have been shown as square in cross section, it will be appreciated that they can be of any other cross-sectional shape, such as round, hexagonal, or any other desired shape.

It is to be again noted that the joints between the various members of the fence which have a friction fit will hold the parts tightly, yet will permit relative movement to allow for expansion and contraction.

It can thus be seen that the plastic fence construction of the present invention is manifestly capable of achieving the above-enumerated objects and while the preferred embodiments of the present invention have been disclosed, it will be appreciated that it is not limited thereto but may be otherwise embodied within the scope of the following claims.

What is claimed is:

1. A plastic fence comprising a plurality of spaced hollow plastic posts, vertically spaced holes in said posts, said holes having substantially parallel sides which are spaced apart a first distance, vertically spaced hollow horizontal plastic rails of substantially uniform continuous hollow rectangular cross section throughout their extent including their ends, each of said plastic rails having outwardly bowed side walls throughout its extent including both of its end portions, said outwardly bowed side walls of each of said rails including its bowed side walls at its end portions being spaced apart a second distance which is greater than said first distance, said outwardly bowed side walls of each of said rails being resilient and flexible at both of said end portions to permit said bowed side walls at both of said end portions of each of said rails to be squeezed together, each of said end portions of said side walls which were squeezed together fitting with direct contact against said substantially parallel sides of said vertically spaced holes with a friction fit.

2. A plastic fence as set forth in claim 1 including opposed horizontally spaced second holes in adjacent rails, said second holes having substantially parallel second sides which are spaced apart a third distance, vertical plastic members extending between said rails, said vertical plastic members being of substantially uniform hollow cross section throughout their extent, each of said vertical plastic members having outwardly bowed opposed second side walls throughout their extent including outwardly bowed second end portions at both ends which are spaced apart a fourth distance which is greater than said third distance, said opposed second side walls and said second end portions being resilient and flexible to permit said second end portions to be squeezed together to fit into said second holes to thereby provide a tight fit.

3. A plastic fence as set forth in claim 2 wherein said second holes have first rounded ends, and wherein said vertical plastic members have second rounded ends for complementary mating engagement with said first rounded ends.

4. A plastic fence as set forth in claim 2 wherein said vertical plastic members have beveled end portions to facilitate assembly into said second holes.

5. A plastic fence as set forth in claim 1 wherein said plastic hollow posts have flexible walls to permit said rails to extend at different angles.

6. A plastic fence as set forth in claim 1 wherein said rails have beveled ends to facilitate assembly into said holes in said posts.

7. A plastic fence as set forth in claim 6 including opposed horizontally second spaced holes in adjacent rails, said second holes having substantially parallel second sides which are spaced apart a third distance, vertical plastic members extending between said rails, said vertical plastic members being of substantially uniform hollow cross section throughout their extent, each of said vertical plastic members having outwardly bowed opposed resilient second side walls throughout their extent including outwardly bowed second end portions at both ends which are spaced apart a fourth distance which is greater than said third distance, said opposed second side walls and said second end portions being resilient and flexible to permit said second end portions to be squeezed together to fit into said second holes to thereby provide a tight fit.

8. A plastic fence as set forth in claim 7 wherein said vertical plastic members have beveled end portions to facilitate assembly into said second holes.

9. A plastic fence as set forth in claim 1 wherein said hollow posts have outwardly bowed resilient sides, a cap member for mounting on top of each post, and straight side wall means on each cap member for receiving the top of each post in mating relationship after said outwardly bowed resilient sides of said posts have been squeezed to thereby provide a tight fit.

10. A plastic fence as set forth in claim 1 including a clearance between adjacent ends of rails within each post to provide room for expansion of said rails.

11. A plastic fence as set forth in claim 1 wherein said posts have centerlines which are spaced apart a greater distance than the length of said rails, and wherein said spaced posts have facing sides which are spaced apart a shorter distance than the length of said rails, and means in the posts at the ends of a fence to prevent removal of rails from said posts.

12. A plastic fence as set forth in claim 1 including weep holes in said posts proximate the ground.

13. A connection between the rail and post of a plastic fence comprising a hollow plastic post, a hole in said post, said hole having substantially parallel sides which are spaced apart a first distance, a plastic rail of substantially continuous hollow rectangular cross section throughout its extent including its end, said plastic rail having outwardly bowed opposed resilient side walls throughout its extent including said end, said outwardly bowed resilient side walls including said end having portions which are spaced apart a second distance which is greater than said first distance, said side walls including said portions at said end being resilient and flexible to permit said portions at said end to be squeezed together to fit into said hole with a friction fit.

14. A connection as set forth in claim 13 and a second connection between said plastic rail and a vertical plastic member comprising a second hole in said rail, said second hole having substantially parallel second sides which are spaced apart a third distance, a vertical plastic member of uniform hollow cross section throughout its extent, said vertical plastic member having outwardly bowed opposed second side walls throughout its extent including its end, said outwardly bowed side walls including portions at said end being spaced apart a fourth distance which is greater than said third distance, said opposed second side walls at said end being resilient and flexible to permit them to be sqeezed together to fit into said second hole to thereby provide a friction fit.

15. A connection as set forth in claim 14 wherein said vertical plastic member has a beveled end portion to facilitate assembly into said second hole.

16. A connection as set forth in claim 14 wherein said second hole also includes first rounded ends, and wherein said vertical plastic member includes second rounded ends for complementary mating engagement with said first rounded ends.

17. A plastic fence as set forth in claim 1 wherein said outwardly bowed side walls are of uniform cross section throughout their length.

18. A plastic fence comprising a plurality of spaced hollow plastic posts, vertically spaced holes in said posts, said holes having sides which are spaced apart a first distance, vertically spaced hollow horizontal plastic rails of substantially continuous uniform cross section throughout their extent, said plastic rails having outwardly bowed side walls throughout their extent including their ends, said outwardly bowed side walls including said ends having portions which are spaced apart a second distance which is greater than said first distance, said ends of said side walls being resilient and flexible to permit them to be squeezed together to fit into said holes with a friction fit, opposed horizontally spaced second holes in adjacent rails, said second holes having second sides which are spaced apart a third distance, vertical plastic members extending between said rails, said vertical plastic members having outwardly bowed second side walls throughout their extent including their ends, said outwardly bowed second side walls including their ends having portions spaced apart a fourth distance which is greater than said third distance, said ends of said second side walls being resilient and flexible to permit them to be squeezed together to fit into said second holes to thereby provide a tight fit.

19. A plastic fence as set forth in claim 18 wherein said second holes have first rounded ends, and wherein said vertical plastic members have second rounded ends for complementary mating engagement with said first rounded ends.

20. A plastic fence as set forth in claim 18 wherein said vertical plastic members have beveled end portions to facilitate assembly into said second holes.

* * * * *

UNITED STATES PATENT AND TRADEMARK OFFICE

CERTIFICATE OF CORRECTION

PATENT NO. : 4,722,514

DATED : February 2, 1988

INVENTOR(S) : Frederick M. Pettit

It is certified that error appears in the above-identified patent and that said Letters Patent is hereby corrected as shown below:

Column 8, line 5 (claim 11), before "posts" insert --spaced--.

Signed and Sealed this

Twenty-first Day of June, 1988

*Attest:*

DONALD J. QUIGG

*Attesting Officer*

*Commissioner of Patents and Trademarks*